US006080275A

United States Patent [19]

Miller

[11] Patent Number: 6,080,275

[45] **Date of Patent: *Jun. 27, 2000**

[54] OXYGEN DELIGNIFICATION OF MEDIUM CONSISTENCY PULP SLURRY

[75] Inventor: William J. Miller, Manchester, N.H.

[73] Assignee: Beloit Technologies, Inc., Wilmington, Del.

[ * ] Notice: This patent is subject to a terminal disclaimer.

[21] Appl. No.: 09/321,452

[22] Filed: May 27, 1999

Related U.S. Application Data

[63] Continuation of application No. 08/825,975, Apr. 4, 1997, Pat. No. 5,916,415, which is a continuation of application No. 08/570,180, Dec. 7, 1995, abandoned.

[51] Int. Cl.[7] ..... D21C 9/147; D21C 9/16

[52] U.S. Cl. ..... 162/65; 162/78

[58] Field of Search ..... 162/19, 57, 65, 162/78

[56] References Cited

U.S. PATENT DOCUMENTS 5,916,415 6/1999 Miller ..... 162/78

*Primary Examiner*—Steven Alvo

*Attorney, Agent, or Firm*—Hill & Simpson

[57] ABSTRACT

A method of oxygen delignification of medium consistency pulp slurry, which includes the steps of providing a pulp slurry of from approximately ten percent to sixteen percent consistency, at a temperature of from approximately 170–240° F., preferably from 190 to 220° F., thoroughly impregnating the slurry with oxygen gas, and with alkali to bring the slurry to a pH of at least 11, more preferably 12, introducing the slurry to oxygen gas in a high shear mixer, for agitating mixing therein, reacting the slurry in a first pressurized reactor for between 5 to 10 minutes, returning the pH of the slurry to at least 11, more preferably 12, with a residual alkali concentration of at least 1.25 gpl, thoroughly impregnating the slurry with $H_2O_2$ and oxygen gas, and reacting the slurry in a second reactor for between 30 to 180 minutes. By only employing the hydrogen peroxide during the slower bleaching reaction, a lower Kappa number with higher % ISO is obtained in the product, these beneficial characteristics being retained in subsequent processing steps.

40 Claims, 1 Drawing Sheet

OXYGEN DELIGNIFICATION OF MEDIUM CONSISTENCY PULP SLURRY

This is a continuation of application Ser. No. 08/825,975, filed on Apr. 4, 1997, now U.S. Pat. No. 5,916,415 which is a continuation of application Ser. No. 08/570,180, filed Dec. 7, 1995, now abandoned.

TECHNICAL FIELD

This invention pertains to improved methods for oxygen delignification and brightening of medium consistency pulp slurry. This method utilizes a two phase reaction design with hydrogen peroxide enhancement.

BACKGROUND OF THE INVENTION

The known methods and apparatii for oxygen delignification of medium consistency pulp slurry consist of the use of high shear mixers and single reactors with retention times of twenty to sixty minutes. These are operated at consistencies of ten to fourteen percent (o.d.) at an alkaline pH of from 10 to 12.5. Oxygen gas and hydrogen peroxide are contacted with the pulp slurry in a turbulent state lasting less than one second. The oxygen gas and hydrogen peroxide are both added prior to the high shear mixer, either simultaneously, or the hydrogen peroxide is added prior to the oxygen by 10–300 seconds. To date, sulfite pulp systems of the aforementioned design have resulted in 60–70% Kappa number reduction and a brightness increase of 20–25% ISO. It has been reported that over half of the Kappa number reduction can occur at the high shear mixer, after the oxygen gas is introduced. Final brightness of 84–86% ISO can be achieved with additional hydrogen peroxide bleaching steps The disadvantages of the known methods is that high total dosages of hydrogen peroxide, often in excess of 5.0% are required to achieve a mid-80's ISO brightness, and this often requires two separate hydrogen peroxide bleaching stages following the oxygen delignification stage.

It is understood that oxygen delignification reaction proceeds under two distinct orders of reaction kinetics. The fist reaction occurs rapidly, and is responsible for lignin fragmentation (delignification). It is a radical bleaching reaction that is dependent on alkali concentration or pH to proceed. It also consumes alkali (e.g., NaOH) as it proceeds and generates organic acids, causing pH to drop by one-half to one point. This is consistent with prior noted field observations. The second reaction occurs slowly, at a rate estimated to be twenty times slower than the first reaction. This reaction is responsible for the destruction of chromophoric structures (brightness development). It is an ionic bleaching reaction that is dependent on alkali concentration, and pH, to proceed. It also will consume alkali as it proceeds and generate organic acids, causing the pH to drop by one to two points during the reaction time.

The addition of hydrogen peroxide ($H_2O_2$) to an oxygen delignification stage will increase both orders of the reaction kinetics, resulting in increased delignification and brightness. It will, for sulfite pulps, have the largest impact on the first rapid, delignification reaction. The impact of the peroxide slows dramatically during the second brightening reaction This may be due to the applied hydrogen peroxide reacting as both a delignification and a brightening agent in the fist reaction. This will consume hydrogen peroxide and increase alkali consumption during the first order reaction Corrections in hydrogen peroxide and alkali will be required for the second reaction to proceed efficiently.

SUMMARY OF THE INVENTION

It is a purpose of this invention to set forth a method for delignification and brightening of pulp in a slurry at medium consistency to a level that will improve subsequent totally chlorine free (TCF) brightness response with minimal bleach chemical usage. This invention utilizes a two phase oxygen delignification concept with hydrogen peroxide being added only to the second reaction phase. The invention can be utilized for retrofits to eking medium consistency oxygen delignification systems as well as for new systems.

To effectively accomplish this objective (OOp), the oxygen delignfication system will be designed with two reactors, each with a dedicated mixer. The first mixer will be a high shear or extended time gas mixer for oxygen gas and alkali and the first reactor will have a retention time of 5–10 minutes (O). The second mixer will be an extended time or high shear mixer for oxygen gas, hydrogen peroxide and alkali and will have a retention time of 30–180 minutes (Op).

The aforesaid, and further purposes and features of the invention will become apparent by reference to the following description, taken in conjunction with the accompanying figures.

DESCRIPTION OF THE PREFERRED EMBODIMENTS

Figure 1:
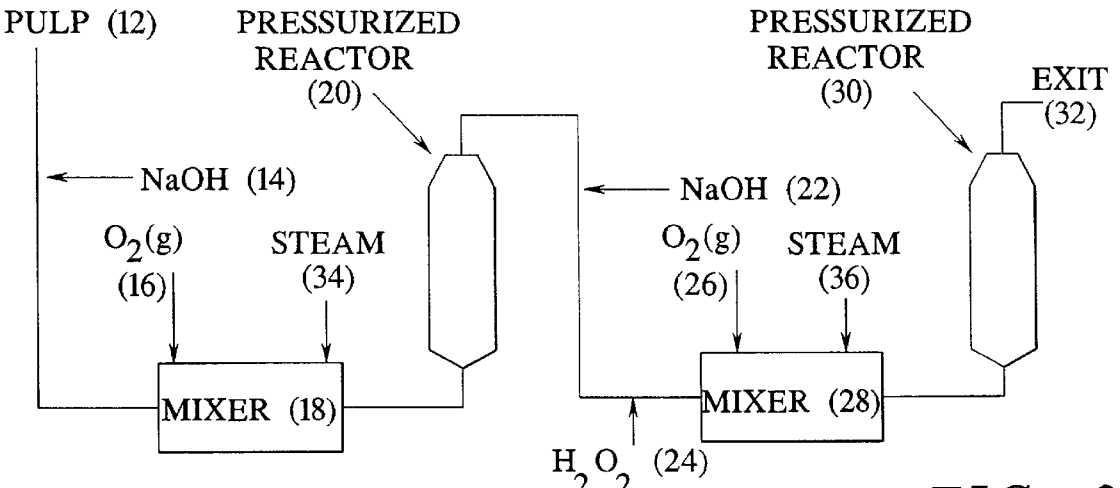
FIG. 1 is a graphical depiction of an O/Op Reaction Flow Diagram for the delignification and brightening for wood pulp.

Referring now to the drawings wherein the showings are for purposes of illustrating the preferred embodiment of the invention only and not for purposes of limiting the same, FIG. 1 shows a reaction schematic which would be used in a preferred embodiment of this invention. In this schematic, the apparatus 10 shows two mixers, a higher shear mixer 18 and an extended contact gas mixer 28 installed in series. Each mixer has a retention time of from less than one second to 5 minutes. The operating pressure of the apparatus 10 and the method which it practices is preferably from approximately 20 to 200 psig. A source 12 of pulp slurry is fed to the high shear or extended time contact gas mixer 18 having a consistency of from approximately 10 to 16%, at a temperature of from approximately 170–240° F., preferably from 190–220° F. A source of alkali is communicated with the mixer 18 either directly or prior to for thorough mixing thereof with the slurry to effect a pH of the slurry from approximately 11.0 or higher, more preferably 12.0 or higher. A source of oxygen gas 16 is provided to communicate with the mixer 18 either directly or prior to for inclusion in the mixing process. The contents of the first mixer 18 are kept agitated for from less than one second to 5 minutes with subsequent transfer to pressurized reactor 20. A source of steam 34 in communication with mixer 18 will insure that the slurry is maintained in the temperature range described. Downstream of this pressurized reactor is a second mixer 28 with associated inlets for alkali 22, oxygen 26 and peroxide 24. The alkali will return the pH of the slurry to at least 11.0, more preferably 12.0, while the oxygen source will replenish depleted oxygen consumed or partially consumed in the first reaction. Another source of steam 36 or the same source identified previously 34 is provided and communicated with the product to bring the slurry temperature back to approximately 170 to 240° F., more preferably 190 to 220° F. The slurry is then agitated in the mixer 28 for less than one second to five minutes. The product is conducted to a second reactor 30 wherein the slower ionic bleaching reaction takes place at a temperature of from 170° F. to 240° F., preferably from 190 to 220° F. The pressure in the first reactor will range from 60–180 psig, and more preferably from 85–140 psig. The pressure in the second reactor will range from 0–180 psig and in one case, preferably from 85–140 psig.

A series of autoclave reactions were performed on Sulfite pulp (brownstock) which was characterized in having a Kappa number of 10.7, a viscosity of 33.4 cps, a brightness of 51% ISO and a Z-span of 18.7 psi. This material served as the baseline case for all testing, the results of which are summarized in the row designated "base" in Table I.

Figure 3:
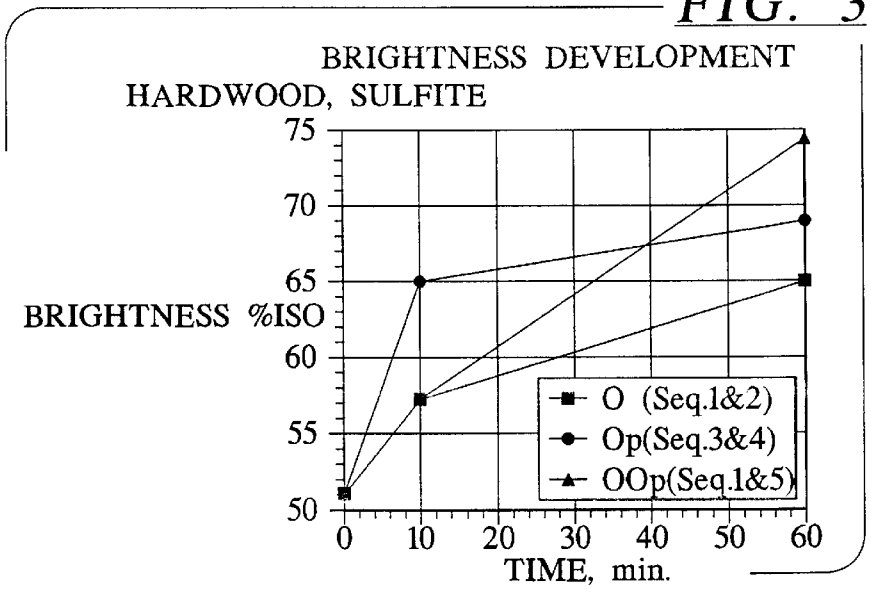
FIG. 3 is a plot of % ISO vs. time (min) making the same comparison as described for FIG. 2.
Figure 2:
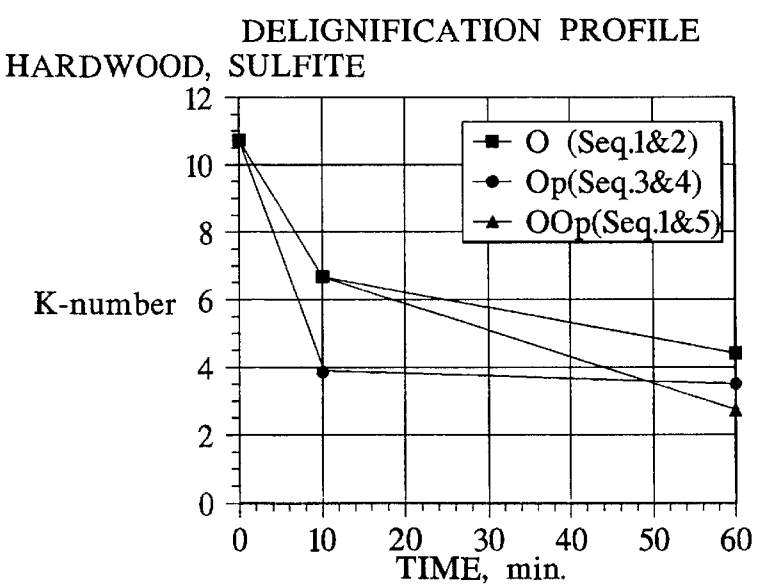
FIG. 2 is a plot of Kappa vs. time (min.) showing the effect of 60 minute oxygen delignification (O), in comparison to 60 minute oxygen delignification with the addition of 0.5% $H_2O_2$ (Op), and 10 minute oxygen delignification followed by 50 minute (Op) stage with the addition of 0.5% $H_2O_2$ (OOp)

The laboratory work described below utilized an autoclave type oxygen reactor. Sequences labeled 1 and 2 show the effects of oxygen delignification (O stage), under constant conditions shown in Table 1, after 10 and 60 minutes. The final pHs are 11.7 and 9.9, respectively. Note that 64% of the total Kappa number drop and less than 45% of the total % ISO gain occur in the first 10 minutes of the total 60 minute reaction. These results are also shown in FIGS. 2 and 3. This is typical of the initial radical delignification reactions.

first rapid delignification reaction. This results in increased NaOH consumption during the initial phase, decreasing the NaOH level and pH during the second phase (11.7 pH for (O) vs. 11.4 pH for (Op) after the initial 10 minutes). This initial phase, with $H_2O_2$ added, competed for available NaOH and $H_2O_2$ to both brighten and delignify, and the kinetics overlapped. Although the end results were improved, (see Sequences 1 & 2 for comparison of final Kappa and % ISO values), this was due to reaction kinetics improvement during the rapid initial phase, (the easy part). Due to NaOH and $H_2O_2$ depletion, the second brightening phase slowed down considerably as shown in Sequence 4 and graphically shown by the essentially flat slope of the final 50 minute part of the Op curve.

$H_2O_2$ is primarily a strong alkali dependent, brightening agent. It is best applied, with additional NaOH, to complement the chemistry of the slower second brightening reaction. The rapid initial delignification is efficient without a significant $H_2O_2$ boost.

Sequences 3,4 and 5 compare the effects of single stage chemical addition in comparison to splitting the two phases of oxygen delignification, i.e., adding 0.5% $H_2O_2$ and the incremental 0.5% NaOH to the second phase only. The total Kappa number drop was increased by 0.7 and the brightness gain was increased by 5.6% ISO. Table 2 shows that single stage peroxide addition in the Op stage reduced the NaOH residual concentration to 0.72 gpl after 10 minutes (Sequence 3), slowing down the secondary reaction to a final 3.4 Kappa number and 68.8% ISO (Sequence 4). The O/Op phase split results in a 1.26 gpl NaoH concentration entering the second 50 minute Op stage. This results in a final Kappa number of 2.7 and 74% ISO (Sequence 5). It can also be concluded from Table 2 that it is beneficial for the final pH after 60 minutes to be above 10.0. It is also noted that

TABLE 1

Oxygen Delignification & Bleaching[a]

| | Stage | Time (min) | Kappa # | ISO | Final pH | Visc cps | Z-span (psi) | T ° C. | NaOH #1[b] | NaOH #2[c] | $H_2O_2$ #1[b] | $H_2O_2$ #2[c] | Resid. NaOH (gpl) |
|---|---|---|---|---|---|---|---|---|---|---|---|---|---|
| 0 | base | 0 | 10.7 | 51.0 | | 33.4 | 18.7 | | | | | | |
| 1 | O | 10 | 6.6 | 57.0 | 11.7 | 32.7 | 14.3 | 100 | 2.5% | — | — | — | 0.50 |
| 2 | O | 60 | 4.3 | 64.9 | 9.9 | 33.1 | 13.9 | 100 | 2.5% | — | — | — | 0.30 |
| 3 | Op | 10 | 3.8 | 65.0 | 11.4 | 32.0 | 12.2 | 100 | 3.0% | — | 0.5% | — | 0.72 |
| 4 | Op | 60 | 3.4 | 68.8 | 9.5 | 32.5 | 14.0 | 100 | 3.0% | — | 0.5% | — | 0.36 |
| 5 | O/Op | 10/50 | 2.7 | 74.4 | 10.0 | 30.2 | 13.7 | 100 | 2.5% | 0.5% | — | 0.5% | 0.25 |
| 6 | O/Op | 10/50 | 3.0 | 71.5 | 10.0 | 29.7 | 12.4 | 90 | 2.5% | 0.5% | — | 0.5% | 0.37 |

[a]Conditions included 100 psig $O_2$ and 0.5% $MgSO_4$
[b]First Reaction (~10 min.)
[c]Second Reaction (~50 min.)

Sequences 3 and 4 show the effects of oxygen delignfication, after 10 and 60 minutes, with the addition of 0.5% $H_2O_2$ and an incremental 0.5% NaOH to the 2.5% NaOH base charge (Op), under conditions shown in Table 1. The final pH values were 11.4 and 9.5 respectively. The level of delignification and % ISO gain was enhanced by the addition of $H_2O_2$ and NaOH, after 10 and 60 minutes. Lower final pH values, compared to Sequences 1 & 2, indicate increased NaOH consumption. Note that 88% of the total Kappa number drop and 78% of the total ISO gain occur in the first 10 minutes of the total 60 minute reaction.

Both the delignification and brightness gain in the second 50 minutes diminished with the addition of $H_2O_2$, when compared to the second 50 minutes with only $O_2$ (see the slope of the Op curve of FIGS. 2 and 3). This may be due, in part, to attempting to both delight and brighten during the Sequences 3,4 and 5 all had overall chemical charges of 3.0% NaOH and 0.5% $H_2O_2$.

TABLE 2

| Seq. | Stage | Time (min) | Initial NaOH (gpl) | Final NaOH (gpl) | Final pH | Final Kappa No. | Final % ISO |
|---|---|---|---|---|---|---|---|
| 3 | Op | 10 | 4.10 | 0.72 | 11.4 | 4.3 | 64.9 |
| 4 | Op | 60 | 0.72 | 0.34 | 9.8 | 3.4 | 68.8 |
| 5 | O | 10 | 3.40 | 0.30 | 11.7 | 6.6 | 57.0 |
| 5 | Op | 50 | 1.26 | 0.25 | 10.0 | 2.7 | 74.4 |

Sequence 6 shows that smaller, but significant, gains in delignification and brightness can be made by operating even at a lower temperature of 90° C. Laboratory studies on oxygen delignification of softwood Kraft pulp have shown this method of peroxide reinforcement to be equally as powerful.

TABLE 3

Delignification response of northern softwood pulp[1] for O, Op and OOp delignification sequences.

| Seq.[2] | Stage(s) | Time (min) | Kappa nbr. | % ISO | Visc. (cps) | Z-span (psi) |
|---|---|---|---|---|---|---|
| base[1] | | | 17.4 | 31.3 | 39.7 | 38 |
| 1 | O | 5 | 15.4 | 32.5 | 28.7 | 29.4 |
| 2 | O | 60 | 10.9 | 36.6 | 23.2 | 26 |
| 3 | Op | 5 | 13.8 | 33.9 | 27.8 | 30.8 |
| 4 | Op | 60 | 10.5 | 36.1 | 23.2 | 27.4 |
| 5 | O | 5 | 15.4 | 32.5 | 28.7 | 29.4 |
| 6 | OOp | 5/55 | 9.8 | 37.2 | 20.9 | 26.6 |

[1]Pulp baseline characteristics
[2]Process variables were:
$O_2$ press. 100 psig
Consistency 12.0%
NaOH 1.4%
$H_2O_2$ 0.5% (Op only)
Temp. 95° C.
$MgSO_4$ 0.5%

This two phase design provides for separate delignification and brightening phases, each with independent chemical controls, results in a second phase enhancement that will improve the overall delignification and brightening results.

Peroxide has typically not been considered as an economical method of enhancement for Kraft oxygen delignification. This conclusion was based on evaluations using conditions similar to those shown in Sequences 3 & 4. This is only a 0.4 Kappa drop improvement over the oxygen delignification Sequences 1 & 2 where no peroxide was added, a performance increase which is too small to be of economic value.

Adding peroxide to the second mixer, allowing the first phase delignification reaction to progress on its own, enhances the delignification by 0.7 Kappa drop (10.5 vs. 9.8) for the same chemical charges. This is an overall Kappa drop improvement of 1.1 (10.9 vs. 9.8) from the oxygen delignification (Sequences 1 and 2).

Table 4 shows that the brightness and delignification gains from utilizing the OOp hardwood sulfite pulp sequence are transferable in the subsequent Z(ozone) P(peroxide) TCF (total chlorine free) bleaching sequence for hardwood sulfite pulp. These benefits result in significantly lower $H_2O_2$ usage in the final P(peroxide) stage to attain an 88% ISO brightness (0.5% vs. 1.5%) and a higher final brightness ceiling above 92% ISO.

TABLE 4

Brightness (% ISO) response of hardwood acid sulfite pulp for Op/Z/P and O/Op/Z/P sequences

| | Op/Z/P | O/Op/Z/P |
|---|---|---|
| Brownstock | 51.0 | 51.0 |
| O and/or Op stages | 68.8 | 71.5 |
| Z stage (0.4%) | 80.0 | 82.7 |
| P stage (0.5%) | 88.7 | 91.0 |
| P stage (1.5%) | 91.2 | 92.6 |

The Op and O/Op stages were the same as stated in Table 1, 12.0% cs (od); the Z stage had a pH=2.7, ambient temperature, 40% cs (od) whereas the P stage had a pH=10.2–10.3, 90° C., 3.5 hrs. 0.5% DPTA, 1.0% $Na_2SiO_3$, and 12.0% cs (od).

From these studies, it is concluded that OOp sequence allows optimum control of the second Op stage. For sulfite with no filtrate recycle to the OOp stage, it is initially recommended that the Op stage following a 10 minute O stage operate at a minimum 1.25 gpl NaOH controlled to a final pH≧10.0. Alkali and pH are also critical for control of the OOp sequence for Kraft, but due to the filtrate recycle of these systems, extrapolations are more difficult.

While I have described my invention in connection with specific embodiment thereof, and specific steps of performance, it is to be clearly understood that this is done only by way of example, and not as a limitation to the scope of the invention, as set forth in the purposes thereof and in the appended claims.

I claim as my invention:

1. A method of oxygen delignification of medium consistency pulp slurry, consisting of the following sequential steps:

providing a pulp slurry of from approximately ten percent to sixteen percent consistency, at a temperature of from approximately 170–240° F.;

adjusting the pH of the slurry to at least 11;

adding oxygen gas to the slurry with agitating mixing therein the absence of $H_2O_2$;

reacting the slurry with the oxygen gas in a first pressurized reactor in the absence of $H_2O_2$ other than an amount of residual $H_2O_2$;

adjusting the pH of the slurry to at least 11;

impregnating the slurry with a first supply of $H_2O_2$ and oxygen gas; and reacting the slurry in a second reactor at a temperature from approximately 170–240° F. while maintaining the final pH to at least 10.

2. A method, according to claim 1, wherein:

said reacting the slurry in the first pressurized reactor step occurs at a pressure of from 60 to 180 psig and a temperature of from 190 to 220° F.

3. A method, according to claim 2, wherein:

said reacting the slurry in the first pressurized reactor step occurs at a pressure of from 85 to 140 psig.

4. A method, according to claim 1, wherein:

said reacting the slurry in the first pressurized reactor step occurs from between about 2 to 30 minutes.

5. The method, according to claim 4, wherein:

said reacting the slurry in the first pressurized reactor step occurs from between about 5 to 10 minutes.

6. A method, according to claim 1, wherein:

said reacting the slurry in the second reactor step occurs at a pressure of from 0 to 180 psig and a temperature of from 190 to 220° F.

7. A method, according to claim 6, wherein:

said reacting the slurry in the second reactor step occurs at a pressure of from 85 to 140 psig.

8. A method, according to claim 6, wherein:

said reacting the slurry in the second reactor step occurs from between about 30 to 180 minutes.

9. The method, according to claim 1, wherein:

said first step of adjusting the pH of the slurry is to a pH of at least 12.

10. The method, according to claim 9, wherein:

said second step of adjusting the pH of the slurry is to a pH of at least 12.

11. The method, according to claim 1, wherein said step of adding oxygen gas to the slurry occurs in a high shear mixer.

12. A method of oxygen delignification of medium consistency pulp slurry, consisting of the following sequential steps:

providing a pulp slurry of from approximately ten percent to sixteen percent consistency, at a temperature of from approximately 170–240° F.;

adjusting the pH of the slurry to at least 11;

adding oxygen gas to the slurry with agitating mixing therein in the absence of $H_2O_2$ other than an amount of residual $H_2O_2$;

reacting the slurry with the oxygen gas in a first pressurized reactor in the absence of $H_2O_2$ other than an amount of residual $H_2O_2$;

adjusting the pH of the slurry to at least 11 and adding sufficient alkali to bring a residual alkali concentration to at least 1.25 gpl;

impregnating the slurry with a first supply of $H_2O_2$ and oxygen gas; and reacting the slurry in a second reactor at a temperature of from approximately 170–240° F. while maintaining the final pH to at least 10.

13. A method, according to claim 12, wherein:

said reacting the slurry in the first pressurized reactor step occurs at a pressure of from 60 to 180 psig and a temperature of from 190 to 220° F.

14. A method, according to claim 13, wherein:

said reacting the slurry in the first pressurized reactor step occurs at a pressure of from 85 to 140 psig.

15. A method, according to claim 12, wherein:

said reacting the slurry in the first pressurized reactor step occurs from between about 2 to 30 minutes.

16. A method, according to claim 15, wherein:

said reacting the slurry in the first pressurized reactor step occurs from between about 5 to 10 minutes.

17. A method, according to claim 12, wherein:

said reacting the slurry in the second reactor step occurs at a pressure of from 60 to 180 psig and a temperature of from 190 to 220° F.

18. A method, according to claim 17, wherein:

said reacting the slurry in the second reactor step occurs at a pressure of from 85 to 140 psig.

19. A method, according to claim 17, wherein:

said reacting the slurry in the second reactor step occurs from between about 30 to 180 minutes.

20. A method, according to claim 12, wherein:

said steps of adjusting the pH of the slurry is to a pH of at least 12.

21. A method of oxygen delignification of medium consistency pulp slurry, consisting of the following sequential steps:

providing a pulp slurry of from approximately ten percent to sixteen percent consistency at a temperature of from approximately 170–240° F.;

adjusting the pH of the slurry to at least 11;

adding oxygen gas to the slurry with agitating mixing therein in the absence of $H_2O_2$ other than an amount of residual $H_2O_2$;

reacting the slurry with the oxygen gas in a first pressurized reactor in the absence of $H_2O_2$ other than an amount of residual $H_2O_2$;

adjusting the pH of the slurry to at least 11 directly following said reacting step;

impregnating the slurry with a first supply of $H_2O_2$ and oxygen gas immediately following said adjusting step; and reacting the slurry in a second reactor at a temperature of from approximately 170–240° F. while maintaining the final pH to at least 10.

22. A method according to claim 21, wherein:

said reacting the slurry in the first pressurized reactor step occurs at a pressure from 60 to 180 psig and a temperature of from 190 to 220° F.

23. A method according to claim 22, wherein:

said reacting the slurry in the first pressurized reactor step occurs at a pressure of from 85 to 140 psig.

24. A method, according to claim 21, wherein:

said reacting the slurry in the first pressurized reactor step occurs from between about 2 to 30 minutes.

25. The method, according to claim 24, wherein:

said reacting the slurry in the first pressurized reactor step occurs from between about 5 to 10 minutes.

26. A method, according to claim 21, wherein:

said reacting the slurry in the second reactor step occurs at a pressure of from 0 to 180 psig and a temperature of from 190 to 220° F.

27. A method, according to claim 26, wherein:

said reacting the slurry in the second reactor step occurs at a pressure of from 85 to 140 psig.

28. A method according to claim 26, wherein:

said reacting the slurry in the second reactor step occurs from between about 30 to 180 minutes.

29. The method, according to claim 21, wherein:

said first step of adjusting the pH of the slurry is to a pH of at least 12.

30. The method, according to claim 29, wherein:

said second step of adjusting the pH of the slurry is to a pH of at least 12.

31. The method, according to claim 21, wherein:

said step of adding oxygen gas to the slurry occurs in a high shear mixer.

32. A method of oxygen delignification of medium consistency pulp slurry, comprising the steps of:

providing a pulp slurry of from approximately ten percent to sixteen percent consistency, at a temperature of from approximately 170–240° F.;

adjusting the pH of the slurry to at least 11;

adding oxygen gas to the slurry with agitating mixing therein in the absence of $H_2O_2$ other than an amount of residual $H_2O_2$;

reacting the slurry with the oxygen gas in a first pressurized reactor in the absence of $H_2O_2$ other than an amount of residual $H_2O_2$; directly followed by adjusting the pH of the slurry to at least 11 and adding sufficient alkali to bring a residual alkali concentration to at least 1.25 gpl;

impregnating the slurry with a first supply of $H_2O_2$ and oxygen gas immediately following said adjusting step; and reacting the slurry in a second reactor at a temperature of from approximately 170–240° F. while maintaining the final pH to at least 10.

33. A method, according to claim 32, wherein:

said reacting the slurry in the first pressurized reactor step occurs at a pressure of from 60 to 180 psig and a temperature of from 190 to 220° F.

34. A method, according to claim 33, wherein:

said reacting the slurry in the first pressurized reactor step occurs at a pressure of from 85 to 140 psig.

35. A method, according to claim 32, wherein:

said reacting the slurry in the first pressurized reactor step occurs from between about 2 to 30 minutes.

36. The method, according to claim 35, wherein:

said reacting the slurry in the first pressurized reactor step occurs from between about 5 to 10 minutes.

37. A method, according to claim 32, wherein:

said reacting the slurry in the second reactor step occurs at a pressure of from 60 to 180 psig and a temperature of from 190 to 220° F.

38. A method according to claim 37 wherein:

said reacting the slurry in the second reactor step occurs at a pressure of from 85 to 140 psig.

39. A method, according to claim 37, wherein:

said reacting the slurry in the second reactor step occurs from between about 30 to 180 minutes.

40. The method, according to claim 32 wherein:

said steps of adjusting the pH of the slurry is to a pH of at least 12.

* * * * *